US009131550B2

(12) United States Patent
Schenk et al.

(10) Patent No.: US 9,131,550 B2
(45) Date of Patent: Sep. 8, 2015

(54) LIGHTING DEVICE HAVING STATUS INDICATION BY MODULATED LIGHT

(75) Inventors: Tim Corneel Wilhelmus Schenk, Eindhoven (NL); Peter Deixler, Eindhoven (NL); Lorenzo Feri, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 145 days.

(21) Appl. No.: 13/263,438

(22) PCT Filed: Mar. 30, 2010

(86) PCT No.: PCT/IB2010/051378

§ 371 (c)(1), (2), (4) Date: Oct. 7, 2011

(87) PCT Pub. No.: WO2010/116289

PCT Pub. Date: Oct. 14, 2010

(65) Prior Publication Data

US 2012/0025740 A1 Feb. 2, 2012

(30) Foreign Application Priority Data

Apr. 8, 2009 (EP) ..... 09157587

(51) Int. Cl.
*H05B 37/00* (2006.01)
*H05B 37/02* (2006.01)
*H05B 37/03* (2006.01)

(52) U.S. Cl.
CPC ..... *H05B 37/0272* (2013.01); *H05B 37/034* (2013.01)

(58) Field of Classification Search
CPC ..... H05B 37/029; H05B 33/0863; H05B 37/0254; H05B 33/0815; H05B 33/0857; H05B 37/02; H05B 33/0842; H05B 37/0272; H05B 33/0803; H05B 37/0245; H05B 33/0818; H05B 33/0869; H05B 33/0872; H05B 37/00
USPC ..... 315/312, 291, 129
See application file for complete search history.

(56) References Cited

U.S. PATENT DOCUMENTS 6,333,605 B1 * 12/2001 Grouev et al. ..... 315/291
6,348,766 B1 2/2002 Ohishi et al.
7,425,798 B2 * 9/2008 St.-Germain ..... 315/129

(Continued)

FOREIGN PATENT DOCUMENTS

DE 102006008040 A1 8/2007
DE 102008056164 A1 4/2010

(Continued)

*Primary Examiner* — Douglas W Owens
*Assistant Examiner* — Monica C King
(74) *Attorney, Agent, or Firm* — Meenakshy Chakravorty

(57) ABSTRACT

It is presented a lighting device (2) arranged to embed light quality data in light emanating from the lighting device. The light quality data pertains to a status of the lighting device (2), e.g. with respect to its end of operational life. The light may be detected by a monitoring device (3) external to the lighting device (2). The monitoring device (3) can then help to determine the status of the lighting device (2), whereby maintenance operations of the lighting device (2) may be carried out. Maintenance personnel may thus replace lighting devices and/or light sources in need of maintenance as indicated by the status of each lighting device, before any lighting device in the system has reached an end of operational life.

3 Claims, 4 Drawing Sheets

(56) References Cited

U.S. PATENT DOCUMENTS

| | | | | |
|---|---|---|---|---|
| 8,264,168 | B2 * | 9/2012 | Feri et al. | 315/294 |
| 2002/0175641 | A1 | 11/2002 | Andersen | |
| 2004/0080715 | A1 | 4/2004 | Miyashita et al. | |

FOREIGN PATENT DOCUMENTS

| | | | |
|---|---|---|---|
| EP | 1976343 | A1 | 10/2008 |
| GB | 2403357 | A | 12/2004 |
| JP | 2005019165 | A | 1/2005 |
| JP | 2008210588 | A | 9/2008 |
| JP | 2008537307 | A | 9/2008 |
| JP | 2009048988 | A | 3/2009 |
| WO | 0133914 | A1 | 5/2001 |
| WO | 2006056066 | A1 | 6/2006 |
| WO | 2006111930 | A2 | 10/2006 |
| WO | 2009040718 | A2 | 4/2009 |
| WO | 2009072053 | A1 | 6/2009 |

* cited by examiner

LIGHTING DEVICE HAVING STATUS INDICATION BY MODULATED LIGHT

TECHNICAL FIELD

The technical field of the present inventive concept is lighting. More specifically, the present inventive concept relates to a lighting device, an external monitoring device, a system, and a method in Solid State Lighting (abbreviated SSL) technology.

BACKGROUND OF THE INVENTIVE CONCEPT

With higher quality SLL light sources nowadays being readily available, it has become desirable to, instead of implementing lighting systems based on incandescent and fluorescent lighting technologies, utilize such SSL light sources for lighting in e.g. office spaces and in public areas such as department stores and airports. There are several reasons for SSL light sources being attractive as light source, based on inherent properties of solid state technology. For instance, SSL light sources provide for more energy-efficient lighting solutions.

Compared to the classical technologies of incandescent and fluorescent lighting, SSL devices such as Light Emitting Diodes and Organic Light Emitting Diodes (abbreviated LED and OLED, respectively) have different lighting characteristics, e.g. light quality of LEDs degrade with time in a way invisible to the eye of an observer, wherein in e.g. fluorescent lighting devices, for instance visible flickering, or part of the tube turning black, is a sign of the device being close to its end of operational life; the light quality is visibly lower than at the start of the light sources' life time. Incandescent light sources simply stop producing light.

For maintenance personnel of lighting systems in e.g. an office environment comprising a large amount of such SSL light sources, where each SSL light source may have been independently regulated and thereby each SSL light source having different burning hours to date, it thus becomes a non-trivial task to know which SSL light sources are to be replaced due to being close to its end of operational life and thus possessing a light quality below existing lighting norms. For example, automatic tuning of light output of lighting devices close to a window may have the consequence that these lighting devices can provide a different amount of burning hours compared to those lighting devices positioned away from windows. Different operating conditions as exemplified above render it more difficult for maintenance personnel to know when to change light sources.

Therefore, there is a risk that a light source is changed at a too early stage of its lifetime, making it both uneconomical and hazardous for the environment in the sense that the light source becomes waste disposal before its actual light quality is below e.g. lighting norms. Alternatively, a light source will not be changed in time, so that it will provide light below lighting norms, or even no light at all until maintenance personnel has been summoned to change the light source in the lighting device.

By replacing all SSL light sources simultaneously, light sources having a light quality below lighting standards may be reduced. However, as mentioned above, such an approach is not desirable, at least from an economical and environmental perspective.

It is known to implement software into an SSL light source, wherein after a predetermined amount of burning hours, the SSL light source starts to e.g. flicker, in order to model the behavior of for instance a fluorescent light source when reaching its end of life.

U.S. Pat. No. 7,425,798 discloses an intelligent degradation-sensing LED traffic signal. A signal can be sent through a communications port to notify that the LED is at the end of its useful life.

SUMMARY OF THE INVENTIVE CONCEPT

It is with respect to the above considerations and others that the present inventive concept has been made.

In view of the above, it would therefore be desirable to achieve an improved lighting device. In particular, it would be advantageous to achieve a lighting device for facilitating the maintenance thereof.

To better address one or more of these concerns, in a first aspect of the present inventive concept there is provided a lighting device comprising: at least one light source, circuitry for establishing a status of said lighting device, and a controller arranged to control a light output of said at least one light source based on said status, thereby embedding light quality data pertaining to said status into light emanating from said lighting device. Thereby, awareness of a present status of the lighting device may be achievable.

The lighting device may for instance be an SSL-based lighting device, such as an LED or OLED device, but may also be beneficial for a fluorescent lighting device.

Beneficially, maintenance personnel carrying out maintenance operations of a lighting system comprising a plurality of lighting devices may replace lighting devices and/or light sources in need of maintenance as indicated by the status of each lighting device, before any lighting device in the system has reached an end of operational life. An end of operational life of a lighting device is to be construed as the time when light output (i.e. luminance level) no longer complies with present lighting norms, which may be due to need of replacement of light source(s) therein, or (part of, or all of) electronics of the lighting device having reached their nominal lifetime.

Light quality data is herein defined as data describing the status of the lighting device with respect to its end of operational life. A lighting device may be associated with unique light quality data describing the status of that specific lighting device.

In one embodiment, the light quality data may relate to a number of burning hours of the light source to date. Thereby, maintenance personnel may more efficiently determine when the lighting device is to reach its end of operational life. The burning hours to date of the light source is to be construed as the total amount of (effective) hours the light source has emitted light.

The circuitry may in one embodiment comprise a memory arranged to store data pertaining to said burning hours to date.

In one embodiment the memory may comprise a data structure in which a burning hours to date of said light source is associated with an expected light output power for said burning hours, and wherein said light quality data pertains to said expected output power. Thereby, maintenance personnel may more efficiently determine when the light source(s) of the lighting device is to reach its end of operational life.

Alternatively, the circuitry may comprise a sensor arranged to measure luminance of light output from the lighting device, wherein said processor may determine the lighting device status of said lighting device and wherein the controller may embed light quality data pertaining to the status in the light emanating from said lighting device. Thereby, a lighting device providing real-time status information of the lighting device may be achievable.

The light quality data may in one embodiment be embedded into said light only after a predetermined amount of burning hours of said lighting device. Thereby unnecessary modulation of light may be avoided until the predetermined amount of burning hours has been reached. Thereby, a more energy efficient lighting device may be provided. Further, wear of electronic components may be reduced thereby.

According to a second aspect of the present inventive concept, there is provided a monitoring device arranged to determine a status of at least one lighting device in a lighting system, the monitoring device being external to said at least one lighting device, wherein the monitoring device comprises: a sensor arranged to detect incident light from said at least one lighting device, and a processor arranged to determine said status based on light quality data embedded into said incident light.

Thereby efficient maintenance of lighting device(s) in a lighting system may be achievable, providing for compliance with present lighting norms. Compliance with lighting norms may further provide e.g. office environments with more efficient employees.

A plurality of lighting devices and at least one monitoring device may form a lighting system. Maintenance of such a lighting system may beneficially be simplified, and lighting norms may thereby be complied with, or at least the risk of non-compliance with lighting norms may be reduced.

The monitoring device may in one embodiment further comprise a monitoring device communications interface arranged to transmit instructions to said at least one lighting device based on said status of said at least one lighting device.

The transmitting of instructions to said at least one lighting device may occur when said status is determined to indicate an end of operational life of said at least one lighting device.

The lighting device may further comprise a lighting device communications interface arranged to receive said instructions, wherein said controller is arranged to control said at least one lighting device in accordance with said instructions.

According to a third aspect of the present inventive concept there is provided a method for facilitating maintenance of a plurality of lighting devices in a lighting system, each lighting device being arranged to emit light in which light quality data pertaining to a lighting device status is embedded, wherein the method comprises: detecting said light at a monitoring device external to said plurality of lighting devices, and determining, in said monitoring device, said status based on said light quality data.

One embodiment may further comprise identifying said plurality of lighting devices. Thereby, devices being close to, or having reached their end of operational life may efficiently be identified.

In one embodiment the identifying may be based on a lighting device identifier embedded into said light. For each lighting device of the plurality of lighting devices, a unique lighting device identifier may thus be embedded in the light emanating from each of the respective lighting devices.

One embodiment may further comprise providing instructions to at least one lighting device when said determining indicates an end of operational life of said at least one lighting device of said plurality of lighting devices. Each lighting device indicating an end of operational life may thus receive instructions from the monitoring device.

One embodiment may further comprise presenting, by said at least one lighting device, said status visually of said at least one lighting device. When instructions have been provided to the at least one lighting device, that lighting device may present its current status by visually indicating for instance an end of operational life. Such visual indication may comprise the lighting device blinking or turning itself off Thereby, maintenance personnel may efficiently identify the lighting device being in need of maintenance operations, e.g. replacement of light source(s). Thus, the external monitoring device may control when the lighting device(s) having reached their end of operational life are to present this. Beneficially, e.g. visible blinking for identification of an end of operational life will thereby only occur during maintenance sessions, whereby e.g. office occupants will not be disturbed by such visible blinking during office hours.

One embodiment may further comprise embedding said light quality data into said light emanating from said plurality of lighting devices only upon request from said monitoring device. Thereby a more efficient lighting device may be achievable in the sense that no modulation (i.e. embedding of light quality data) of light may be needed at times when no maintenance operations are carried out. In particular, electronics of the lighting device may hence obtain a longer operational life.

The above aspects and others of the inventive concept will be apparent from and elucidated with reference to the embodiments described hereinafter.

BRIEF DESCRIPTION OF THE DRAWINGS

Embodiments of the present inventive concept will now be described in more detail, with reference to the enclosed drawings.

DETAILED DESCRIPTION OF EMBODIMENTS

Figure 1:
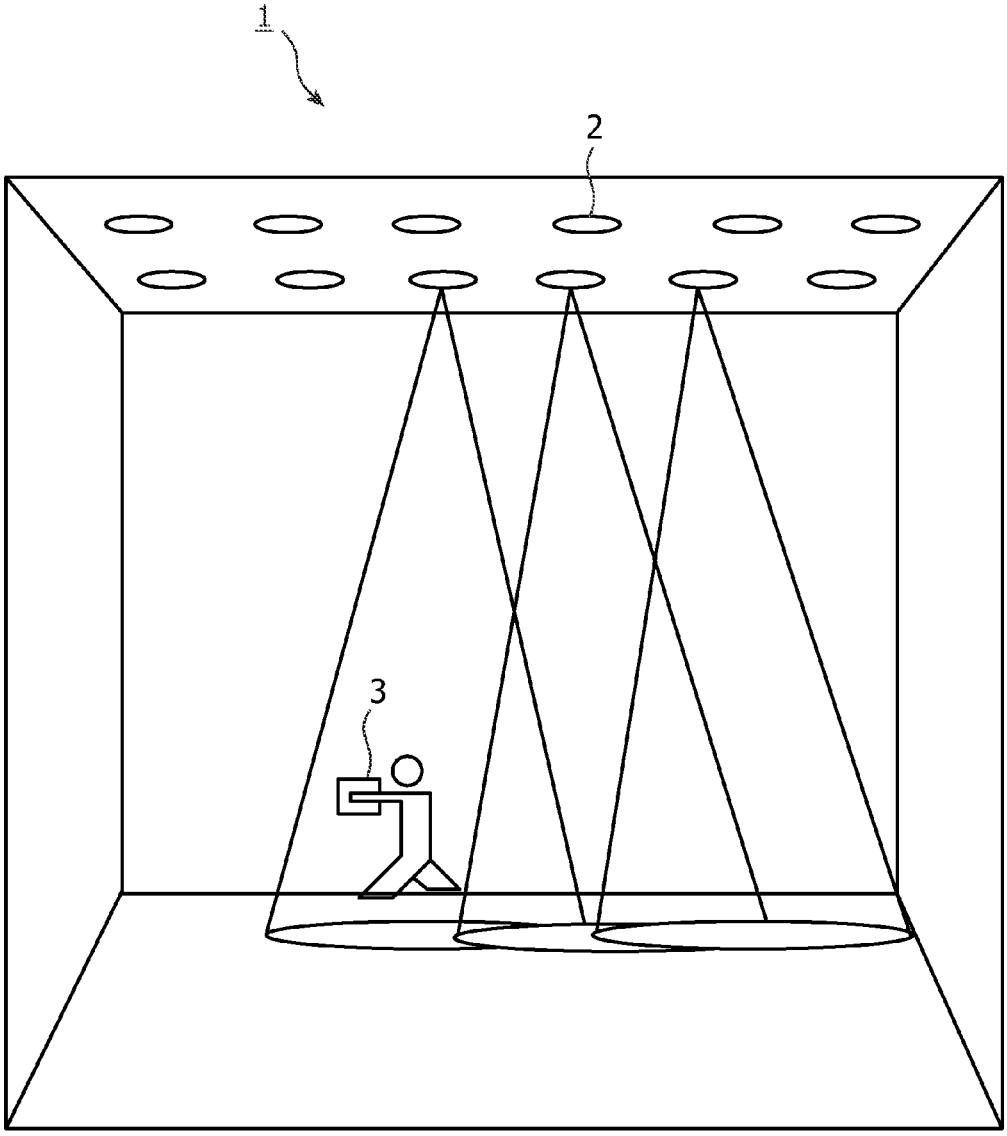
FIG. 1 shows a lighting system according to an embodiment of the inventive concept.

FIG. 1 shows a lighting system 1 according to an embodiment of the inventive concept. The inventive lighting system 1 can comprise a plurality of lighting devices 2, with for instance SSL light sources such as LEDs, and a monitoring device 3 external to the plurality of lighting devices 2, which monitoring device 3 can e.g. be operated by lighting system maintenance personnel.

Generally, the inventive concept disclosed herein may facilitate for maintenance personnel to identify lighting devices 2 having reached, or being close to their operational end of life, whereby the lighting device 2, or components thereof may be replaced. Thereby, luminance levels in an area illuminated by the lighting system 1 conforming to lighting norms such as EN-12464 may be achievable.

An non-limiting example, to illustrate the general functioning of the inventive concept during a maintenance session, may for instance be as follows:

Maintenance personnel may enter an area comprising lighting system 1, carrying the monitoring device 3 with him. The lighting devices 2 may provide, for humans invisible, light quality data embedded into emanating light of the lighting devices 2, which light quality data is detected by the monitoring device 3. The monitoring device 3 can then indicate, via for instance a display, the status of the lighting devices 2 in the lighting system 1. Thereby, maintenance personnel may identify lighting devices 2 in need of maintenance operations in the lighting system 1, where such operations may include replacement of light sources 4, and/or replacement of some electronics of the lighting device 2, or replacement of one or several complete lighting devices 2.

A lighting device being close to its end of operational life is herein to be understood as a lighting device 2 reaching its end of operational life prior to a next scheduled maintenance session. Therefore, replacement of such lighting devices is desirable at a present maintenance session.

Thus, by means of the inventive monitoring device 3, lighting devices 2 being close to, or subject to their end of operational life may beneficially be identified.

Advantageously, the inventive concept may provide improved light quality in e.g. an office environment or a public area comprising a plurality of lighting devices. Beneficially, light quality of the lighting system 1 may be able to conform to lighting norms. In an office environment, the annoyance level of office occupants can be reduced in that visibly flickering light sources notifying that the end of operational life is at hand for a specific light source of a lighting device can be avoided.

A detailed description of exemplary embodiments of the inventive concept follows herebelow.

Figure 2:
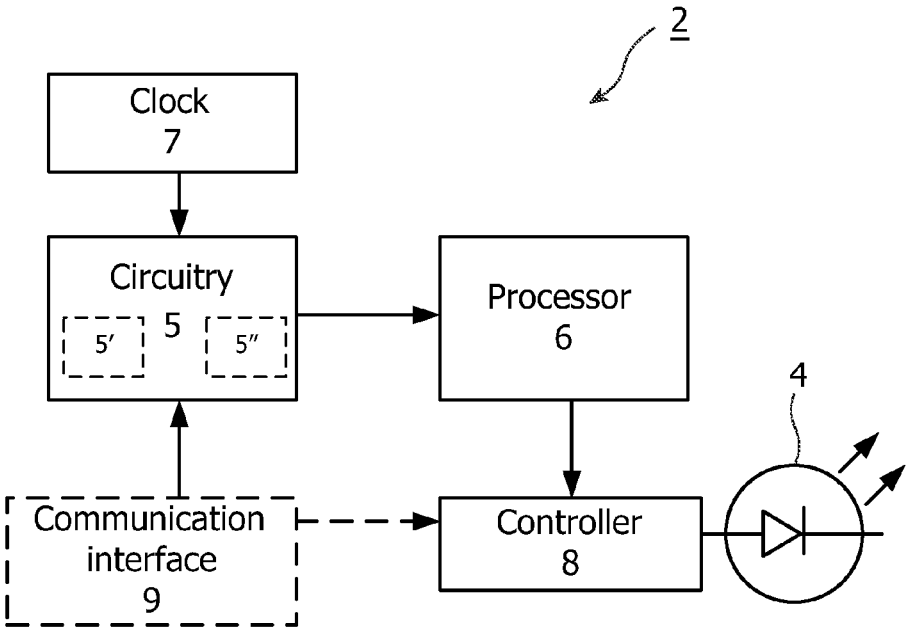
FIG. 2 shows a block diagram of one embodiment of a lighting device according to the inventive concept.

FIG. 2 shows a block diagram of one embodiment of the lighting device 2 according to the inventive concept. The lighting device 2, which may be comprised in the lighting system 1, comprises, inter alia, at least one light source 4, e.g. an LED, OLED or other similar SSL light source(s), a processor 6, a clock 7, which may be incorporated into the processor 6, a controller 8, and circuitry 5 to establish a status of the lighting device 2. Alternatively, the light source 4 may be comprised of a plurality of LEDs or other SSL light sources.

The circuitry 5 may in one embodiment comprise a memory 5' for storing light quality data relating to an end of operational life of the lighting device 2. The memory may optionally comprise a lighting device identifier (abbreviated ID), identifying the specific lighting device 2. If the lighting device 2 comprises several light sources 4, the memory 5' can also comprise at least one light source ID for the identification of a specific light source 4 of the lighting device 2. The clock 7 may be able to communicate with the memory 5' in order to update the light quality data of the lighting device 2. In this sense, the light quality data may be dynamic in that it is updated by the clock 7.

Alternatively, the circuitry 5 can comprise a photosensitive sensor 5" for measuring the luminance of the light emanating from the lighting device 2 and provide the luminance data to the processor 6 for processing of this data. The processor 6 may then instruct the controller 8 to embed light quality data in emanating light based on the measured luminance. Light quality data in embodiments having the sensor 5" is to be understood as being dynamic, i.e. it does not (only) comprise static data, as at least part of a light quality data packet comprises data pertaining to the lighting device's end of operational life, which as such changes with time in the sense that e.g. luminance levels decrease with time.

The controller 8, which can be an electrical driver providing supply voltage to the light source(s) 4, can control light output of the light source(s) 4. For instance dimming or advanced modulation, involving e.g. switching, of light emanating from the lighting device 2 may be achieved. As mentioned above, the light quality data can be retrieved by the processor 6 for instructing the controller 8. Thereby, the controller 8 can embed light quality data as well as lighting device ID and light source ID into light emanating from lighting device 2. The modulation of light is preferably invisible to humans, i.e. humans may preferably not detect any switching of the light with their eyes. Methods which may be used to modulate the light to include e.g. light quality data can for instance be Pulse Width Modulation, Pulse-Position Modulation, Amplitude Modulation, Frequency Modulation, or any other suitable modulation, as will be apparent to the person skilled in the art.

Optionally, the lighting device 2 can comprise a lighting device communications interface 9. The lighting device communications interface 9 may be used to provide instructions to the controller 8. Such instructions can for instance be dimming instructions or instructions from the monitoring device 3 for visually modulating the light emanating from the lighting device 2.

Some non-limiting examples will follow herebelow to illustrate what kind of data pertaining to the end of operational life of the light source(s) 4 may be embedded in the light emanating from the lighting device 2. It should be noted that several other solutions are possible within the scope of the claims.

Example 1

The light quality data can describe the number of burning hours to date of the light source(s) 4. The clock 7 counts the number of burning hours to date of the light source(s) 4 and updates the memory 5 with this information. Updates can for instance be on an hourly basis, or a daily basis.

Example 2

The light quality data can describe the number of burning hours to date of the lighting device 2, as well as that of the light source(s) 4. The clock 7 counts the number of burning hours to date of the light source(s) 4 as well as that of the lighting device, and updates the memory 5 with this information. Updates can for instance be on an hourly basis, or a daily basis. The number of burning hours to date of the lighting device 2 may thus differ from that of the light source(s) 4, since light sources as such may be replaced several times, wherein the electronics of the lighting device 2 may be unchanged for several light source(s) replacements.

Example 3

The burning hours to date can relate to the burning hours of the electronics of the lighting device 2. Such electronics may be electronics on e.g. a printed circuit board on which SSL source(s) are mounted.

Example 4

Dimming operations can be accounted for when calculating an expected time to end of operational life of the light source(s) 4. More specifically, the memory 5 may comprise a lookup table, in which, for each light intensity, an end of operational life for the light source(s) 4 can be calculated. The lookup table also contains an expected light output power for a specific burning hours to date. For instance, if the light source(s) 4 has been in a state of 50% available light output for 5 hours, this may correspond to e.g. 3 hours of burning time with 100% available light output. Available light output in this context should be construed as the available light output of the light source(s) 4 when taking into account the burning hours to date.

Example 5

The lighting device 2 can comprise a plurality of light sources 4, such as SSLs (e.g. LEDs), each with different color output. If for instance a warmer light is desired from the lighting device 2, light sources with red light output may be used more intensely than some other light sources within the same lighting device 2. Therefore, light sources within the same lighting device 2 may have different end of operational life. A look-up table can be provided in the memory 5 for each specific color, whereby an end of operational life for each colored light source 4 may be calculated.

Example 6

The burning hours of the light source(s) 4 is related to an expected light output power of the light sources 2. The expected light output power can then be embedded into the emanating light as light quality data.

Generally, the data packets embedded into the light comprising e.g. the light quality data and light source ID can be transmitted with emanating light either in continuous repeated transmission, or as randomly timed transmissions. Different fields of the data packet can contain various information of the lighting device 2, such as a field which may contain the lighting device ID. Another field may for example contain the number of burning hours to date of the light source 4. In one embodiment, a field may contain information about an expected end of operational life of the light source 4.

In one embodiment, it is envisaged that the lighting system 1 comprises a combination of different type of lighting devices 2, for instance a first set of lighting devices 2 having LED light sources 4, and a second set of lighting devices 2 having OLED light sources 4. The light quality data packet may then comprise a field denoting the type of light source 4, as well as a field comprising for instance the burning hours to date.

Thereby, facilitation of maintenance operations may be achievable in that maintenance personnel may recognize what type of light source(s) needs to be replaced.

Figure 3:
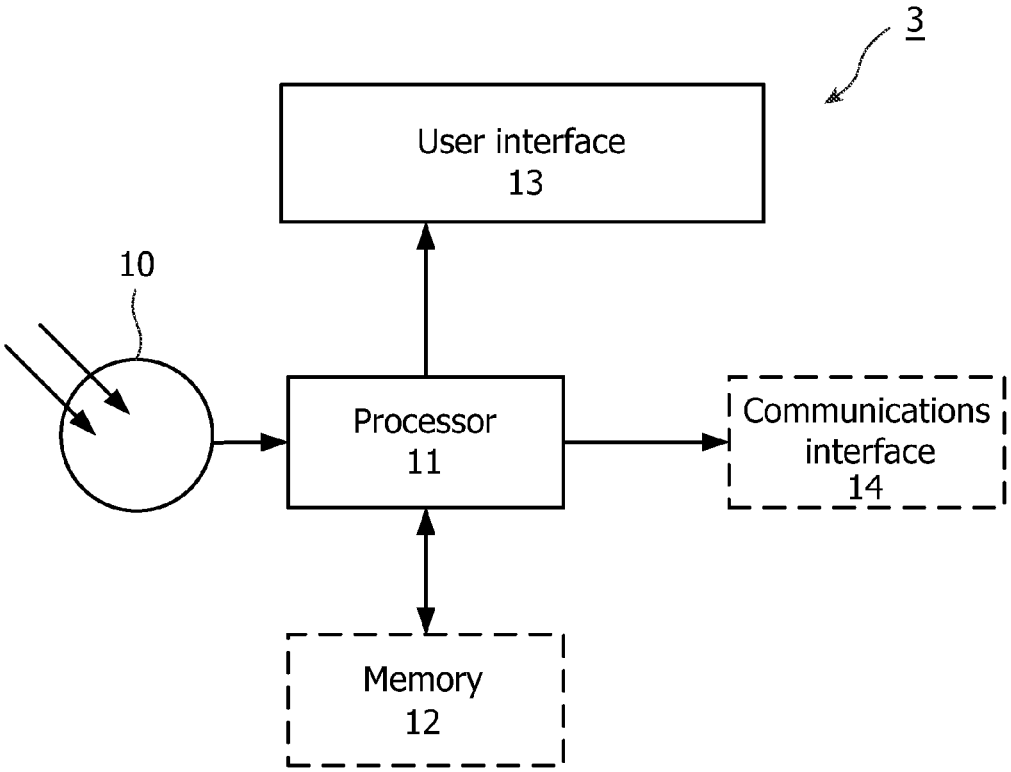
FIG. 3 shows a block diagram of an embodiment of a external monitoring device according to the inventive concept.

FIG. 3 shows a block diagram of an embodiment of the monitoring device 3 according to the inventive concept. The monitoring device 3 can be used in the lighting system 1 to facilitate maintenance of the lighting system 1.

In particular, the inventive monitoring device 3 may e.g. provide a better work environment for office occupants (e.g. lighting norms being fulfilled, no visible flickering as end of operational life approaches etc), as well as making lighting system 1 maintenance more economical and environmental friendly.

The monitoring device comprises inter alia a photosensitive sensor 10, a processor 11, and a user interface 13. The sensor 10 can detect incident light from e.g. lighting devices 2, whereas the processor 11 can demodulate the detected light which has been modulated by the lighting device 2. The processor 11 thereafter interprets the data provided therein, i.e. light quality data from lighting devices 2. The user interface 13 is arranged to present for a user, e.g. maintenance personnel, the light quality data. For instance, the number of burning hours to date may be presented on a display screen. Thereby, the user can decide whether lighting devices 2 or light source(s) 4 needs to be replaced or not, depending on whether the burning hours have exceeded a predetermined number of burning hours after which replacement needs to be performed.

Alternatively, the processor 11 may itself determine whether replacement of lighting device 2 or light source(s) 4 needs to be performed, wherein the outcome is presented to the user of the monitoring device 3. Such presentation may for instance comprise indicating the necessity of replacement via LEDs, or alternatively, displaying a text on a display screen of the user interface 13.

The monitoring device 3 may advantageously be portable in order to facilitate for maintenance personnel to bringing it to areas comprising lighting systems 1 to carry out maintenance operations thereon.

Examples of how the monitoring device 3 may be used in the lighting system 1 will be presented below.

Pointing

As maintenance personnel enters an area comprising the lighting system 1, he or she points the monitoring device towards a specific lighting device 2. In this case, the light quality data does not necessarily contain the light source ID, since the maintenance personnel knows which lighting device 2 is pointed at. Light quality data may for instance be embedded and transmitted continuously when applying pointing with the monitoring device 3, if the lighting device 2 comprises a single light source 4. The user interface 13 can then present information coded into the light quality data, such as the number of burning hours to date, wherein the maintenance personnel can decide whether the light source 4, lighting device 2, or electronics thereof needs to be replaced, as has been described above. Alternatively, the processor 11 may determine whether replacement needs to take place or not.

If the lighting device 2 has a plurality of light sources 4 (of which an example is given above, where a lighting device 2 has several different colored light sources 4), such as a plurality of LEDs, light source IDs for each LED may be embedded with the light quality data in the light emanating from each light source 4 of the lighting device 2. Light quality data is preferably embedded in the light at scheduled times or using different carrier frequencies to reduce the risk of collision of data. Identification of the light source(s) 4 which needs to be replaced will be described in more detail with reference to FIG. 4.

Multiple Lighting Devices

The monitoring device, in this case equipped with wide field-of-view optics, can receive light from a plurality, or sometimes all the lighting devices 2 of the lighting system 1 at once. Light quality data is preferably embedded in the light at random times to reduce the risk of data collision. Alternatively, other multiple access techniques such as TDMA, FDMA and CDMA might be applied. Moreover, the light quality data comprises light source ID for each lighting device 2. In a first example, the user interface 13 presents the number of lighting devices 2 with light sources 4 needing to be replaced after the monitoring device 3 has collected and analyzed the light quality data from the plurality of lighting devices. Since it may not be clear to the maintenance personnel which light source ID belongs to which lighting device 2, the maintenance personnel/user of the monitoring device 3 can manually inspect each lighting device 2 of the lighting system 1 according to the pointing example as explained above, to explicitly find which lighting devices 2 need maintenance, i.e. which light sources 4 needs to be replaced. It is of course to be understood that the same technique may be applied to identify lighting devices 2 which needs to be replaced, or electronics therein in need of replacement.

In embodiments in which no communication between lighting device communications interface 9 of the lighting device 2 and an optional monitoring device communication interface 14 of the monitoring device 3 is performed, the light quality data is preferably transmitted at random times. However, in some embodiments comprising communications interfaces 9 and 14, signaling between the monitoring device 3 and the lighting devices 2 indicating a change from multiple light source mode to pointing mode, light quality data being transmitted randomly switching to continuous transmission is envisaged.

Figure 4:
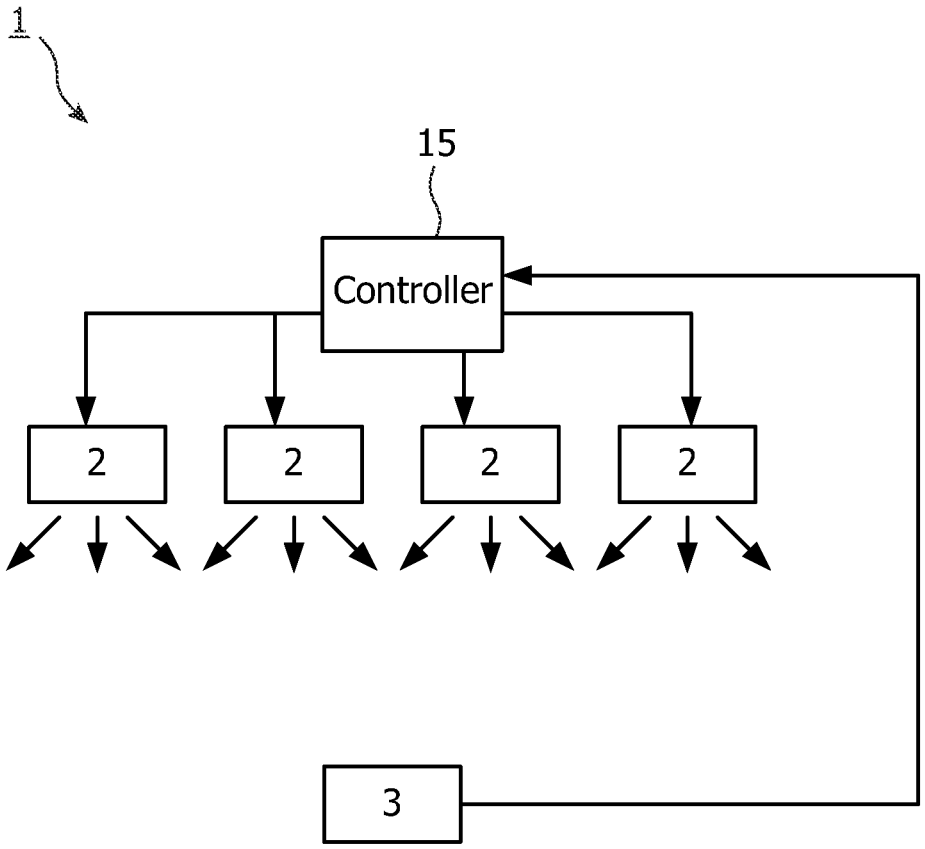
FIG. 4 shows a block diagram of one embodiments of the system in FIG. 1.

An alternative to the two-step approach of multiple light source/pointing is described herebelow with reference being made to FIG. 4.

FIG. 4 shows a block diagram of an embodiment of the lighting system 1 in FIG. 1. Each lighting device 2 comprises the lighting device communications interface 9, and the monitoring device 3 comprises the monitoring device communications interface 14. The lighting system 1 further comprises a controller 15 coupled to the lighting devices 2.

The sensor 10 of the monitoring device 3 detects incident light from the plurality of lighting devices 2. Light quality data from each lighting device 2 is embedded in their emanating light at random time intervals (as mentioned above other methods of multiple access may also be applied), for reducing the risk of data collision. The lighting device ID for each lighting device 2 is included in the light quality data.

Alternatively, light source IDs may also be included in the light quality data.

The processor 11 thereafter interprets the light quality data received from the lighting devices 2. If the light quality data contains information indicating that the end of operational life is close of a light source 4 or lighting device 2, and that therefore maintenance is needed, the processor 11 provides this information with the corresponding lighting device/source ID to the communications interface 14, which in turn preferably wirelessly transmits instructions based on this information to the controller 15. The controller 15 communicates the instructions to the relevant lighting device 2, i.e. the lighting device 2 in need of maintenance, via communications interface 9. This way, each lighting device 2 being close to or having reached its end of operational life will be notified of this. In particular, the communications interfaces 9 of the concerned lighting devices 2 will provide the instructions to the controller 8 of these lighting devices 2. Each respective controller 8 can then control the light output of their respective light source(s) 4 to identify and present the status, i.e. having reached the end of operational life, of the affected lighting devices 2. The control of light output may for instance comprise visibly blinking the affected light source(s) 4, or switching the light source(s) 4 off. Maintenance personnel can thereafter replace the light source(s) 4 now having been identified as having reached the end of operational life.

In one embodiment, the lighting devices 2 will embed their light quality data in the light upon request from the monitoring device 3. For instance, when maintenance personnel is to carry out maintenance operations of the lighting system 1, the monitoring device 3 may transmit instructions via interface 14 to the lighting devices 2 by means of the communications interface 15, instructing the lighting devices 2 to start embed light quality data to their emanating light.

In one embodiment, the monitoring device 3 may measure light parameters such as luminance level of detected light from lighting devices 2 and transmit these parameters to the respective lighting devices 2 via the monitoring device communication interfaces 14.

Figure 5:
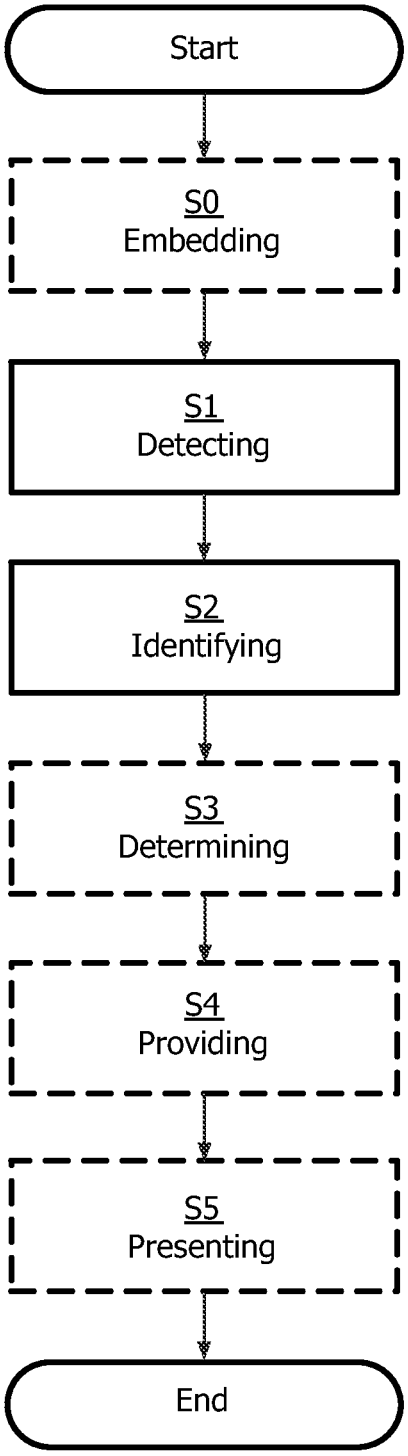
FIG. 5 shows a flow chart illustrating maintenance of lighting devices in the lighting system of FIG. 1.

FIG. 5 shows a flow chart illustrating maintenance of the lighting system 1.

In an optional step S0, light quality data is embedded into light emanating from the plurality of lighting devices upon request from the monitoring device 3. In other embodiments, the light quality data is always embedded in the light, or alternatively, after a predetermined amount of burning hours to date of each lighting device 2.

In a step S1, light from a lighting device 2 is detected by the photosensitive sensor 10 of the monitoring device 3.

In an optional step S2, the lighting device 2 is identified by means of the lighting device ID embedded into the light emanating from the lighting device 2. The lighting device ID can be comprised in the light quality data. Optionally, the light source ID can also be embedded in the light, and thereby the specific light source 4 of a lighting device 4 may also be identified.

In a step S3, the status of the lighting device 2 is determined. As described in more detail above, the determining may alternatively comprise determining the status of the light source(s) 4 of the lighting device 2, and/or the status of electronics therein. Hence, it is determined whether the light source(s) 4 and/or electronics of the lighting device 2 has reached its end of operational life or not. In some particular cases, the lighting device 2 as such may have reached its end of operational life if for instance a plurality of components on a circuit board of the lighting device has reached their end of operational life, wherein the complete lighting device 2 needs to be replaced.

In an optional step S4, instructions can be provided to the lighting device(s) 2 in the lighting system 1 which are subject to having reached their end of operational life, or alternatively, being close to reaching their end of operational life.

In an optional step S5, the status of the lighting device 2 is presented. The status may for instance be presented to maintenance personnel on a display of the monitoring device 3 (which display may be a part of the user interface 13). Alternatively, the status of the lighting device 2 may, if an end of operational life has been determined, be presented by the lighting device 2 itself as disclosed hereabove with reference to FIGS. 3-4. In this case, the monitoring device 3 transmits instructions e.g. to the controller 15 of the lighting system 1, wherein the lighting device 2 having reached an end of operational life for instance starts to visibly blink, or switch itself off, thereby identifying itself for maintenance personnel. In one embodiment, the monitoring device 3 may directly transmit instructions to the lighting device communications interfaces 9.

Embodiments comprising steps S4 and S5 thereby provide lighting devices 2 an monitoring device 3 functioning both as senders and receivers.

Thereby, the inventive monitoring device 3 can instruct the lighting devices 2 when to indicate their status visibly in case of end of operational life, or if end of operational life is near.

In general, the inventive lighting system 1 may thus efficiently mitigate any inconveniences caused by visibly blinking or visibly flickering light sources of lighting devices, and the light sources may effectively be utilized as long as they conform to lighting norms. Moreover, the inventive lighting system 1 provides for a more economical and environmental friendly maintenance of the lighting system 1.

Applications of the present inventive concept include, but are not limited to, indoor environments such as office environments, hotels, and shopping centers, as well as outdoor environments comprising lighting systems. Less efficient maintenance methods may thereby be replaced by the inventive concept presented herein.

While the inventive concept has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. The mere fact that certain measures are recited in mutually different dependent claims does not indicate that a combination of these measures cannot be used to advantage. Furthermore, any reference signs in the claims should not be construed as limiting the scope.

The invention claimed is:

1. A lighting system comprising:

at least one lighting device, each including at least one light source;

an internal clock;

circuitry including a memory for establishing light quality data of said lighting device and for each of the at least one light source;

the light quality data further including a lighting device identifier and a light source identifier;

a controller to control modulated light output of said at least one light source and embedding the light quality data in the modulated light output;

at least one monitoring device for determining a status of the at least one lighting device, the monitoring device being external to said at least one lighting device and comprising a transmitter operable to transmit a set of instructions to the at least one lighting device to embed the light quality data in the modulated light output;

a sensor arranged to detect incident light from said at least one lighting device, a processor arranged to determine said status based on the light quality data embedded into said incident light and able to determine associated light quality data for each of the at least one lighting device and each of the at least one light source;

the transmitter operable to transmit a second set of instructions to the at least one lighting device to provide visible indication of an end of life condition;

wherein the controller in the lighting device is responsive to the second set of instructions transmitted by the monitoring device and modifies the light output to visibly blink or switch off in order to be visibly identified.

2. A lighting device having status indication by modulated light, comprising:

a controller operable to control a plurality of lighting devices, the controller including a communication interface, each of the plurality of lighting devices including at least one light source;

an internal clock;

circuitry including memory for establishing light quality data of said lighting device and for each of the at least one light source, the light quality data including status of electronics in said lighting device;

the light quality data further including a lighting device identifier and a light source identifier;

the controller operable to control modulated light output of each of said plurality of lighting devices and embedding the light quality data in the modulated light output for each of said plurality of lighting devices;

at least one monitoring device for determining a status of the at least one lighting device, the monitoring device being external to said at least one lighting device and including a transmitter operable to transmit a set of instructions to the at least one lighting device and to receive the embedded light quality data in the modulated light output;

a sensor arranged to detect incident light from said at least one lighting device, a processor arranged to determine said status based on the light quality data embedded into said incident light and able to determine associated light quality data for each of the at least one lighting device and each of the at least one light source;

the transmitter operable to transmit a second set of instructions to the at least one lighting device to provide visible indication of an end of life condition;

wherein the controller in the lighting device maintains a burning hours counter for the lighting device and limits the embedding of the light quality data in the modulated light output for each of said plurality of lighting devices until after a predetermined amount of burning hours.

3. A method for facilitating maintenance of a plurality of lighting devices in a lighting system, each lighting device being arranged to emit light in which light quality data pertaining to a lighting device status is embedded, wherein the method comprises:

controlling by a controller light output of a plurality of lighting devices, the controller further having a communications interface;

transmitting by a remote monitoring device a set of instructions to the controller a set of maintenance operations instructions for the controller to embed light quality data for each of the plurality of lighting devices in the modulated light output;

modulating the light output of each of said plurality of lighting devices;

embedding light quality data in the modulated light output for each of said plurality of lighting devices;

receiving by the remote monitoring device the light quality data for each of the plurality of lighting devices;

determining, by the remote monitoring device, a status for each of the plurality of lighting devices;

transmitting to the communications interface of the controller the status for each of the plurality of lighting devices;

presenting, where required by each of the plurality of lighting devices, a visual status indicating an end of operational life, said visual status including one of blinking or turning off.

* * * * *